US010354814B2

(12) United States Patent
Gerving et al.

(10) Patent No.: US 10,354,814 B2
(45) Date of Patent: Jul. 16, 2019

(54) QUENCHING PLATE ARRANGEMENT FOR A SWITCHING DEVICE

(71) Applicant: Eaton Electrical IP GmbH & Co. KG, Schoenefeld (DE)

(72) Inventors: Karsten Gerving, Bonn (DE); Volker Lang, Bonn (DE); Johannes Meissner, Bonn (DE); Ralf Thar, St. Augustin (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/538,198

(22) PCT Filed: Dec. 17, 2015

(86) PCT No.: PCT/EP2015/080137

§ 371 (c)(1),
(2) Date: Oct. 6, 2017

(87) PCT Pub. No.: WO2016/102289

PCT Pub. Date: Jun. 30, 2016

(65) Prior Publication Data

US 2018/0174775 A1 Jun. 21, 2018

(30) Foreign Application Priority Data

Dec. 22, 2014 (DE) ..... 10 2014 119 474

(51) Int. Cl.
*H01H 9/30* (2006.01)
*H01H 9/36* (2006.01)
(Continued)

(52) U.S. Cl.
CPC ..... *H01H 9/36* (2013.01); *H01H 9/302* (2013.01); *H01H 9/443* (2013.01);
(Continued)

(58) Field of Classification Search
CPC ..... H01H 9/36; H01H 9/302; H01H 9/345; H01H 9/346; H01H 9/46; H01H 2009/367;
(Continued)

(56) References Cited

U.S. PATENT DOCUMENTS 4,585,912 A * 4/1986 Fischer ..... H01H 9/346 218/158
5,003,137 A * 3/1991 Tateishi ..... H01H 9/36 218/151
(Continued)

FOREIGN PATENT DOCUMENTS

CN 201918286 U 8/2011
CN 103366989 A 10/2013
(Continued)

OTHER PUBLICATIONS

Translation DE3833808 (Original document published May 11, 1989) (Year: 1989).*

*Primary Examiner* — Edwin A. Leon
*Assistant Examiner* — William A Bolton
(74) *Attorney, Agent, or Firm* — Leydig, Voit & Mayer, Ltd.

(57) ABSTRACT

A quenching plate arrangement for a switching device has plural quenching plates for arc splitting and/or lengthening; a guiding plate, the quenching plates being arranged substantially next to one another to firm a stack, the guiding plate laterally delimiting the stack, the guiding plate protruding beyond the quenching plates in a main extension direction; and a DC-suitable switching device having a first contact and a second contact, at least the second contact being movable relative to the first contact, a first and second running rail arrangement for conducting an arc with respective first and second current directions, the two running rail arrangements having respective first and second running
(Continued)

rails, the two first and two second running rails respectively running in opposite directions from the first and second contacts, and the first running rails being connected in an electrically conducting manner in closed loop form, with the quenching plate arrangement.

14 Claims, 3 Drawing Sheets

(51) Int. Cl.
*H01H 9/44* (2006.01)
*H01H 1/20* (2006.01)
*H01H 33/18* (2006.01)

(52) U.S. Cl.
CPC ..... *H01H 33/182* (2013.01); *H01H 1/20* (2013.01); *H01H 2009/367* (2013.01)

(58) Field of Classification Search
CPC ..... H01H 33/182; H01H 33/04; H01H 33/08; H01H 33/10; H01H 33/20; H01H 1/20; H01H 9/362; H01H 2009/365
USPC .. 218/151, 148, 149, 81, 15, 34, 36, 38, 39, 218/40, 26
See application file for complete search history.

(56) References Cited

U.S. PATENT DOCUMENTS

| | | | | |
|---|---|---|---|---|
| 5,583,328 | A | 12/1996 | Mitsuhashi et al. | |
| 7,259,646 | B2 * | 8/2007 | Rab | H01H 9/346 335/201 |
| 7,679,020 | B2 * | 3/2010 | Schulz | H01H 9/443 218/26 |
| 8,519,292 | B2 * | 8/2013 | Domejean | H01H 9/346 218/23 |
| 2010/0170876 | A1 | 7/2010 | Bach et al. | |
| 2014/0151340 | A1 | 6/2014 | Nahata et al. | |
| 2014/0175057 | A1 | 6/2014 | Gerving et al. | |

FOREIGN PATENT DOCUMENTS

| | | | | | |
|---|---|---|---|---|---|
| CN | 203826250 | U | | 9/2014 | |
| DE | 1076224 | B | | 2/1960 | |
| DE | 1905588 | A | | 8/1969 | |
| DE | 3833808 | A1 | * | 5/1989 | H01H 9/302 |
| DE | 69315384 | T2 | | 4/1998 | |
| DE | 102005022213 | A1 | | 11/2006 | |
| DE | 102008021025 | A1 | | 10/2008 | |
| DE | 102007028204 | A1 | | 12/2008 | |
| EP | 2747109 | A1 | | 6/2014 | |
| IN | 201100637 | I4 | | 3/2011 | |
| IN | 201100637 | I3 | * | 7/2013 | |
| JP | 63264829 | A | | 11/1988 | |

* cited by examiner

QUENCHING PLATE ARRANGEMENT FOR A SWITCHING DEVICE

CROSS-REFERENCE TO RELATED APPLICATIONS

This application is a U.S. national stage application under 35 U.S.C. § 371 of International Application No. PCT/EP2015/080137, filed on Dec. 17, 2015, and claims benefit to German Patent Application No. DE 10 2014 119 474.8, filed on Dec. 22, 2014. The International Application was published in German on Jun. 30, 2016, as WO 2016/102289 A1 under PCT Article 21(2).

FIELD

The invention relates to a quenching plate arrangement for a switching device, comprising a plurality of quenching plates for splitting and/or lengthening an arc, and comprising at least one guiding plate.

BACKGROUND

For switching off currents in consumer networks, switching devices are generally used that comprise one or more current paths that in turn comprise fixed and movable contacts. The movable contacts are movable together between a closed position, in which the mutually associated movable and fixed contacts touch one another, and an open position, in which an isolating distance is formed in each case between the mutually associated movable and fixed contacts. Once the movable contacts move into the open position under a load, in other words a flow of current, arcs occur along the isolating distances. The spark duration of the arcs determines the switching time for which the flow of current between the contacts is maintained. Further, the arcs release a large amount of heat, which leads to thermal destruction of the contacts and of parts of the switching chamber in the direct vicinity of the contacts, and thus to a reduction in the service life of the switching device. It should therefore be aimed to quench the arcs as rapidly as possible, this being possible for example by way of arc quenching devices. By way of these quenching devices, the arcs are for example divided into individual sub-arcs. Once the total of the sub-arc voltages is greater than the driving voltages, the arcs are quenched.

In switching devices for DC applications, the arc is not interrupted automatically, as would be the case for each zero of an alternating current. Therefore, in DC applications, blowing magnets are used, which generate a directed magnetic field in which the arcs are deflected due to the Lorentz force, which is used to drive the arcs to the arc quenching devices. In the quenching devices, the arc voltage is increased by extending and cooling the arc and dividing it into sub-arcs, resulting in the arc being quenched.

A corresponding switching device, suitable for DC operation, is known for example from EP 2 747 109 A1, in which a quenching device for quenching an arc is provided, comprising a first running rail arrangement for conducting an arc having a first current direction and comprising a second running rail arrangement for conducting an arc having a second current direction into said quenching chamber. The two running rail arrangements each have a first running rail and a second running rail, the two first running rails extending from a fixed contact in opposite directions and the two second running rails extending from a movable contact in opposite directions. To provide a switching device that has a high service life even if high-energy switching arcs occur, for example in a highly inductive circuit, it is proposed therein for the first running rails to be electrically conductively interconnected in the form of a closed loop. In the presence of high-energy switching arcs, in particular if there is a large inductive portion in the circuit, it may occur that an arc that enters the quenching chamber only loses part of its energy therein and is not yet fully quenched. In this case, arc-backs may occur after it passes through the quenching chamber, in such a way that the arc subsequently commutes from the outer end of the quenching chamber to the end of the running rails and in some cases runs back toward the contacts. Depending on the shape of the switching chamber, the arc may also burn in place at some points, for example at the end points of the running rails, leading to a correspondingly increased arc spark duration and thus an increased thermal load on the switching chamber, which can thus lead to a reduced electrical service life for the switching device.

SUMMARY

An aspect of the invention provides a quenching plate arrangement for a switching device, the arrangement comprising: a first and a second quenching plate configured to split and/or lengthen an arc; and a first and a second guiding plate, wherein the quenching plates are arranged substantially side by side to form a stack, wherein the guiding plates laterally delimit the stack on both sides, wherein the guiding plate protrudes beyond the quenching plates in a primary extension direction, and wherein the guiding plate includes a slit that extends from a guiding plate end remote from the quenching plates.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
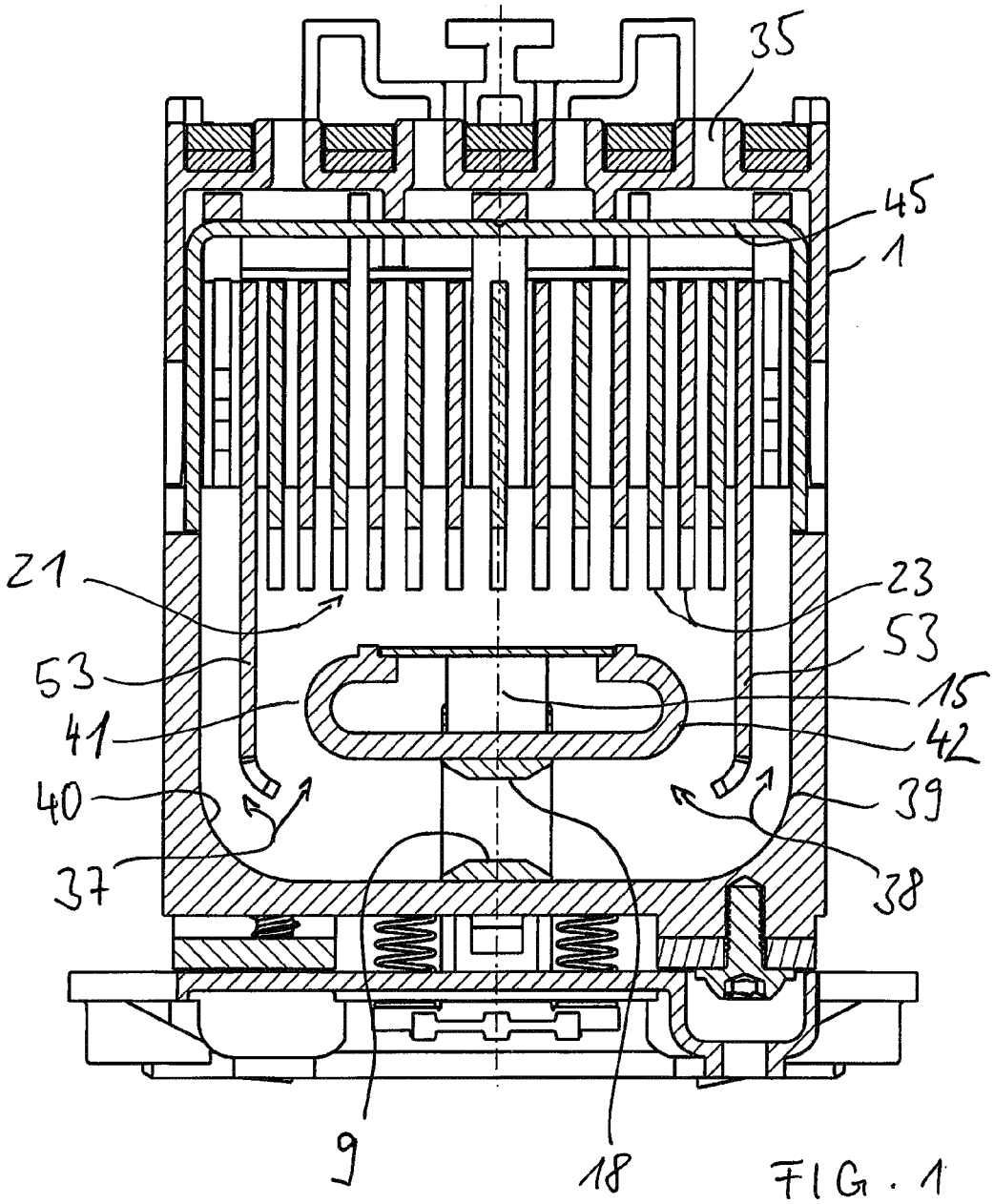
FIG. 1 a sectional view of a switching chamber of a switching device according to the invention comprising a first embodiment of the quenching plate arrangement according to the invention.

The invention provides a quenching plate arrangement for a switching device, comprising a plurality of quenching plates for splitting and/or lengthening an arc, and comprising at least one guiding plate, the quenching plates being arranged substantially side by side to form a stack and the guiding plate laterally delimiting the stack, the guiding plate protruding beyond the quenching plates in a primary extension direction; and to a switching device, suitable for DC operation, comprising at least a first contact and a second contact, at least the second contact being movable with respect to the first contact, comprising a first running rail arrangement for conducting an arc having a first current direction and comprising a second running rail arrangement for conducting an arc having a second current direction, the two running rail arrangements each having a first running rail and a second running rail, the two first running rails extending from the first contact in opposite directions and the two second running rails extending from the second contact in opposite directions, and the first running rails being electrically conductively interconnected in the form of a closed loop, comprising a quenching plate arrangement of this type.

An aspect of the invention provides a quenching plate arrangement that increases the service life of switching devices in which switching arcs are supplied by energy that is stored in particular in an inductive portion in a circuit, in such a way that the energy released in a time-delayed manner by the inductors has to be dissipated by way of an arc entering the quenching chamber before said arc is quenched, this being associated with a longer spark duration of the arc. An aspect of the invention provides a switching devices having increased service life.

A quenching plate arrangement according to the invention for a switching device comprises a plurality of quenching plates for splitting and/or lengthening an arc and at least one guiding plate, the quenching plates being arranged substantially side by side to form a stack and the guiding plate laterally delimiting the stack. The quenching plates and the guiding plate are substantially plate-shaped components that thus have a length in a primary extension direction and a width that are each much greater than a thickness of the components. The components are arranged side by side to form a stack within the meaning of the invention if the planes spanned by the lengths and widths are arranged mutually parallel. The wording "substantially side by side" means that the quenching plates and the guiding plate may also not be arranged exactly mutually parallel, in other words that adjacent quenching plates may be at an angle to one another or to the guiding plate. A gap is generally formed between adjacent quenching plates, in such a way that no quenching plate touches any other. The guiding plate protrudes beyond the quenching plates according to the invention in the primary extension direction, in other words in length. The quenching plates may be the same length as or different lengths than one another, but none of them is as long as the guiding plate. Further, according to the invention it is provided that the guiding plate comprises a slit, the slit extending from an end of the guiding plate remote from the quenching plates.

An advantage of the quenching plate arrangement having a slitted guiding plate is that an arc gains an additional guide, the slit being provided for rapidly guiding the arc into the stack of quenching plates and thus out of the region of a switching chamber in which an accumulation of ionized gases is to be prevented. The guiding plate is explicitly not an arc conducting rail, but instead part of the quenching plate arrangement.

The term guiding plate is used herein without necessarily being limiting in relation to a guiding function. The guiding plate is not limited in functionality to guiding the arc, but rather provides a multiple functionality, specifically:

- rapidly guiding the arc out of the contact region, with the aim of bringing about rapid electrical resolidification by minimizing ionization of this region;
- partitioning off the switching chamber wall;
- preventing arc short-circuiting in the regions to the side of the quenching plate package; and
- delaying the movement of the arc once it reaches the quenching plates, so as to promote the arc entering the package of quenching plates over a wide front, in such a way that insofar as possible all plates of the quenching plate package are covered.

A preferred embodiment provides that the slit extends over a sub-length of the guiding plate, the sub-length in particular being limited to a part of the guiding plate that protrudes beyond the quenching plates. As a result of this embodiment, the guidance of the arc along the guiding plate ends at an end of the slit, resulting in the arc pausing at the end of the slit. Since the arc is thus already located in the region of the quenching plates, and no longer in the region of the switching chamber at risk from the action of the arc, delaying the progression of the arc is advantageous so as to dissipate as much energy as possible by way of the high arc voltage in the quenching chamber before the arc in some cases runs back to the contacts and is driven into the quenching plates again. This advantageously increases the dwell time of the arc in the region of the quenching plates and shortens it in the region outside the quenching plates.

A further preferred embodiment provides that the slit opens into a recess at an end closer to the quenching plates, the recess having a greater width than the slit. In other words, the slit widens at the end thereof. The larger recess makes it possible to keep the arc longer, and leads to a reduced load from the thermal action at the slit end.

Although the shape of the recess can be selected as desired, an embodiment in which the recess tapers in a V shape from an end connected to the slit is preferred. This means that the slit forms an arrow shape with the recess. Since the slit opens into the wide part of the V-shaped or triangular recess, a dwell time of the arc therein is increased, so as to make it possible for said arc to penetrate between as many quenching plates as possible, preferably all of them, where the arc is divided up into sub-arcs so as to multiply up the arc voltage as much as possible.

A further preferred embodiment provides that an edge along the slit and along the recess has as bevel on both sides at least in portions. This advantageously increases a dwell time of the arc at the edge.

A further preferred embodiment provides that the slit opens in a V-shaped groove at the end of the guiding plate remote from the quenching plates. As a result of a groove on the input side, the arc is received more easily and is rapidly passed to the slit.

A further preferred embodiment provides that an intermediate plate is arranged on a face of the guiding plate remote from the quenching plates arranged to form a stack, the intermediate plate being longer than the quenching plates and shorter than the guiding plate. More preferably, a distance between the first running rails of the switching device and the respectively adjacent intermediate plates and a distance between the intermediate plates and the respectively adjacent guiding plates are provided, this distance in each case being less than a distance of the quenching plates from one another, so as to increase a dwell time of the arc in the region and prevent short-circuiting. For this purpose, the intermediate plates preferably also comprise V-shaped grooves on the entry face.

In a further preferred embodiment, two guiding plates are provided, the guiding plates delimiting the stack on both sides. The embodiment is provided for switching devices in which the direction in which the arc is driven is not known in advance, in other words for polarity-independent switching devices. In this case, the two guiding plates are preferably configured substantially identically and arranged mirror-symmetrically with respect to one another, in other words opposite one another at the two ends of the quenching plate stack. The second guiding plate further advantageously performs a partitioning function, in that a short circuit to the inactive running rail of the switching device is prevented by the second guiding plate.

A further preferred embodiment provides that in the plurality of quenching plates a distance between adjacent quenching plates varies in each case, in other words that they are not arranged equidistant. In particular, it is provided that the distance decreases from the center of the stack toward the guiding plates.

All features and embodiments of the quenching plate arrangement mentioned herein can be transferred mutatis mutandis to the embodiment having two guiding plates. For example, preferably two intermediate plates may be provided that each flank the guiding plates on the outer face. The quenching plate arrangement is further preferably formed as a deionizing quenching chamber comprising a plurality of electrically conductive quenching plates and guiding plates and optionally intermediate plates that are electrically insulated from one another.

A further subject matter of the invention is a switching device suitable for DC operation, comprising at least one pair of contacts, the pair of contacts comprising a first contact and a second contact, at least the second contact being movable with respect to the first contact, a quenching device comprising at least a quenching chamber for quenching an arc occurring between the first contacts and the second contacts being provided, comprising a first running rail arrangement for conducting an arc having a first current direction and comprising a second running rail arrangement for conducting an arc having a second current direction into said quenching chamber, the two running rail arrangements each having a first running rail and a second running rail, the two first running rails extending from the first contact in opposite directions and the two second running rails extending from the second contact in opposite directions, the first running rails being electrically conductively interconnected in the form of a closed loop. The term "closed loop" means that a type of closed electric circuit is established, which may be formed in any desired shape, for example in the form of a ring. In this context, running rails should also be considered closed within the meaning of the invention even if they have short interruptions, so long as the interruptions can readily be bridged by arcs. As a result of the closed loop, an arc that completely passes through the quenching plates cannot be formed again on the rear face as a stationary sparking arc, which would damage the housing of the switching device. Instead, the arc is kept in continuous movement in the permanently magnetic blowing field, said movement initially guiding it back to the contacts and subsequently guiding it to pass through the quenching device again. For this purpose, the first running rails are interconnected by a bracket behind the quenching device. Advantageously, the quenching device has exactly one quenching chamber, and the running rail arrangements are configured in such a way that the arc is conducted into the one quenching chamber regardless of the current direction and the running direction of the arc. According to the invention, a quenching plate arrangement is arranged within the closed loop formed by the first running rails, as disclosed above, in such a way that the thermal load on individual regions within the switching chamber is greatly reduced and the arc dwells longer in the region of the quenching plate arrangement, increasing the overall life expectancy of the switching chamber.

In a further preferred embodiment of the switching device, a quenching plate arrangement comprising two guiding plates is provided, the two second running rails being arranged between the two guiding plates when the contacts are open.

The two second running rails are preferably likewise electrically conductively interconnected in the form of a closed loop.

FIG. 1 is a sectional view through a switching chamber 1 of a switching device according to the invention comprising a first embodiment of a quenching plate arrangement 21 according to the invention. To conduct an arc (not shown) that forms between a first contact 9 and a second contact 18 when the contacts 9, 18 are separated, two running rail arrangements are provided, specifically a first running rail arrangement 37 and a second running rail arrangement 38. The first running rail arrangement 37 is used to conduct an arc having a first current direction into a quenching device, in this case the quenching plate arrangement 21 according to the invention. The second running rail arrangement 38 is used to conduct an arc having an opposite, second current direction into the same quenching plate arrangement 21. The corresponding switching device comprising a plurality of switching chambers 1 is disclosed in depth in EP 2 747 109 A1, to which reference is hereby made, and is not discussed in greater detail herein.

As a result of a homogeneously formed magnetic field (not shown), a Lorentz force is exerted on the arc in a known manner, and drives it laterally away from the contacts 9, 18. Depending on the current direction, the arc is driven to the left or to the right. If the arc is driven to the left in FIG. 1, the first running rail arrangement 37 is used to conduct the arc. If the arc is driven to the right in FIG. 1, the second running rail arrangement 38 is used to conduct the arc. The two running rail arrangements 37, 38 each have a first running rail 39, 40 and a second running rail 41, 42, between which the arc continues to be formed. The first running rails 39, 40 are connected to the fixed contact 9. The second running rails 41, 42 are connected to a bridge contact piece 15 and the moving contact 18, it being possible for the second running rails 41, 42 to be formed by an integral component that extends around the face remote from the first contact 9 once, in other words forms a closed loop in the form of a ring.

In this case, the closed running rail arrangement 41, 42 proceeding from the movable second contact 18 is arranged eccentrically in the interior of the closed running rail arrangement 39, 40 of the fixed contact 9, specifically in such a way that in two regions the running rail arrangement 39, 40 on the fixed contact side extends parallel to the running rail arrangement 41, 42 on the moving contact side in each case. In the region of the two contacts 9, 18, the distance between the running rails is thus at a minimum, whilst the distance is much greater in the opposite parallel zone in which the quenching plate arrangement 21 is arranged.

The first running rail 40 of the first running rail arrangement 37 initially extends to the left and subsequently upward, deflected through 90°, the distance between the first running rail 40 and the second running rail 41 gradually increasing. The arc therefore continues to be formed between these two running rails 40, 41, and is driven to the left and subsequently upward by the contact pair 9, 18 in the case of a first current direction. As it continues to progress, the arc extends along on the rear face of the bridge contact piece 15 remote from the first contact 9, the arc gradually being driven into the gaps between the individual quenching plates 23. On the upper face of the switching chamber 1, blow-off channels 35 are provided for blowing arc gases out of the switching chamber 1. The second running rail arrangement 38 is constructed identically, mirror-symmetrically.

For a highly inductive circuit, in which a major part of the electrical power is determined by the inductors in the circuit, this power is dissipated in a delayed manner by way of the arc after the contacts 9, 18 are opened. For the dissipation of the power, it is particularly advantageous in this case if the arc enters the quenching plate arrangement 21 over a wide front under the effect of the permanently magnetic blowing field, and is split therein into a large number of individual arcs, so as subsequently to commute to a connecting web 45 of the running rails 39, 40 on the fixed contact side. As a result of the constant blowing field effect, an arc bridge is subsequently formed between the side plate of the quenching plate arrangement 21 and the opposite side limb of the running rails 39, 40 on the fixed contact side, as a result of which the arc subsequently runs back in the direction of the contacts 9, 18. After passing the contacts 9, 18, the arc can subsequently run along the running rails 39, 40, 41, 42 again in the direction of the quenching plate arrangement 21. For a sufficient residual power, one or more further running cycles may also be formed, until the arc has finally dissipated all of the power of the circuit, in such a way that it is extinguished. The arc voltage does fall again briefly after passing through the quenching plate arrangement 21 and being commuted to the running rails 39, 40 on the fixed contact side, but this fall is rapidly compensated for by the continuous onward movement of the arc and by it running into the quenching plate arrangement 21 again. The arc voltage constantly increases again until the arc is finally extinguished. The continuous thermal effect proceeding from the arc over a relatively long time does mean a higher load on the switching chamber 1 overall, but in this way the continuous onward movement of the arc largely prevents "baking" in sub-regions of the switching chamber 1, which would be associated with a major reduction in the life expectancy of the switching device.

The quenching plate arrangement 21 according to the invention comprises a plurality of quenching plates 23 for splitting and/or lengthening the arc and two guiding plates 53, the quenching plates 23 being arranged substantially side by side to form a stack, and the guiding plates 53 laterally delimiting the stack. The quenching plates 23 and the guiding plates 53 are substantially plate-shaped components, and a gap is formed in each case between adjacent quenching plates 23, in such a way that no quenching plate 23 touches any other. According to the invention, the guiding plates 53 protrude beyond the quenching plates 23 in the primary extension direction thereof, in other words in length. In this case the quenching plates 23 are the same length as one another, but they could also be of different lengths to some extent. However, no quenching plate 23 is as long as the guiding plates 53. A distance between every two adjacent quenching plates 23 preferably varies, in other words the quenching plates 23 are not arranged equidistant. In particular, the distance decreases from the center of the stack of quenching plates 23 toward the guiding plates 53, causing a passage time of the sub-arcs through the package of quenching plates 23 to vary over the extension of the package. This advantageously achieves that the sub-arcs approximately simultaneously reach the upper end in the drawing of the package of quenching plates 23, even if beforehand the splitting of the arc into the individual sub-arcs and the penetration thereof into the quenching plate packet 23 have not taken place simultaneously.

Figure 2:
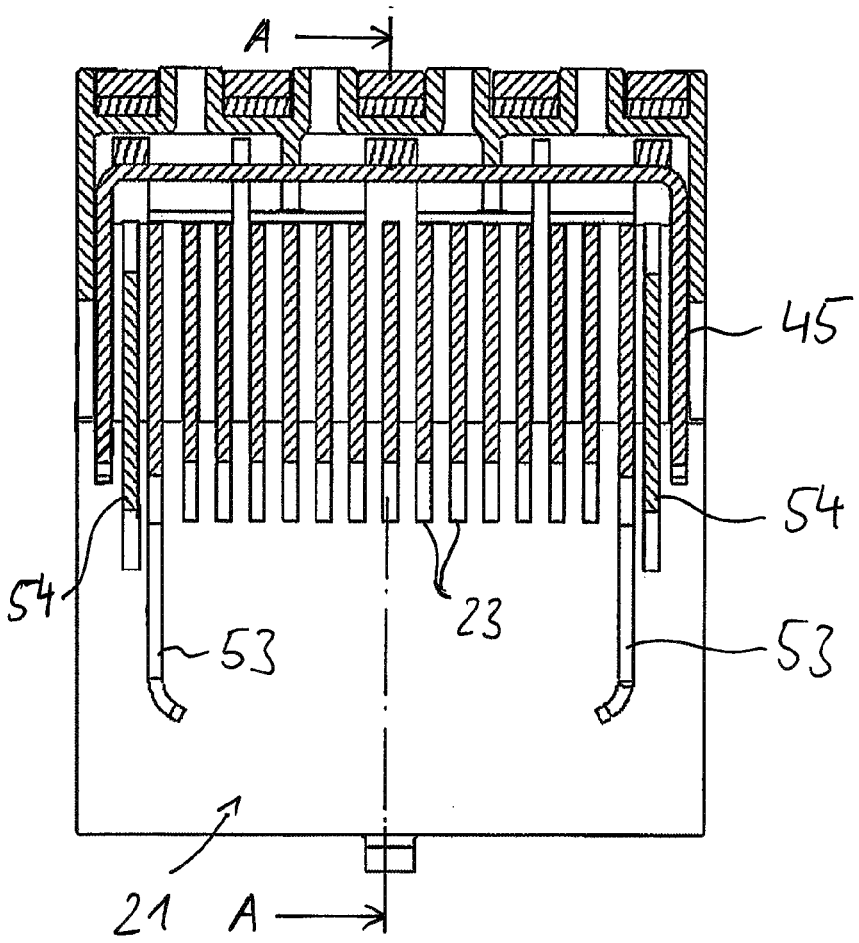
FIG. 2 a sectional view of a second embodiment of the quenching plate arrangement according to the invention without a switching device.

FIG. 2 shows a second embodiment of the quenching plate arrangement 21 according to the invention. This differs from the first embodiment according to FIG. 1 in that two intermediate plates 54 are additionally provided, and are each arranged on an outer face of the quenching plate arrangement 21, in other words on a face of the guiding plates 53 remote from the quenching plates 23 arranged to form a stack. In this case, the intermediate plates 54 additionally protect a switching chamber wall from the effect of the arc. The intermediate plates 54 have a V-shaped groove 5, which causes the arc to pause at the groove 5. A distance between the first running rails (39, 40, see FIG. 1), or a connecting bracket 45 that extends the first running rail and connects it behind the package of quenching plates 23, and the respectively adjacent intermediate plates 54 and a distance between the intermediate plates 54 and the respectively adjacent guiding plates 53 are less than a distance between the quenching plates 23.

In the following, the guiding plates 53 are disclosed in greater detail with reference to FIG. 3.

Figure 3:
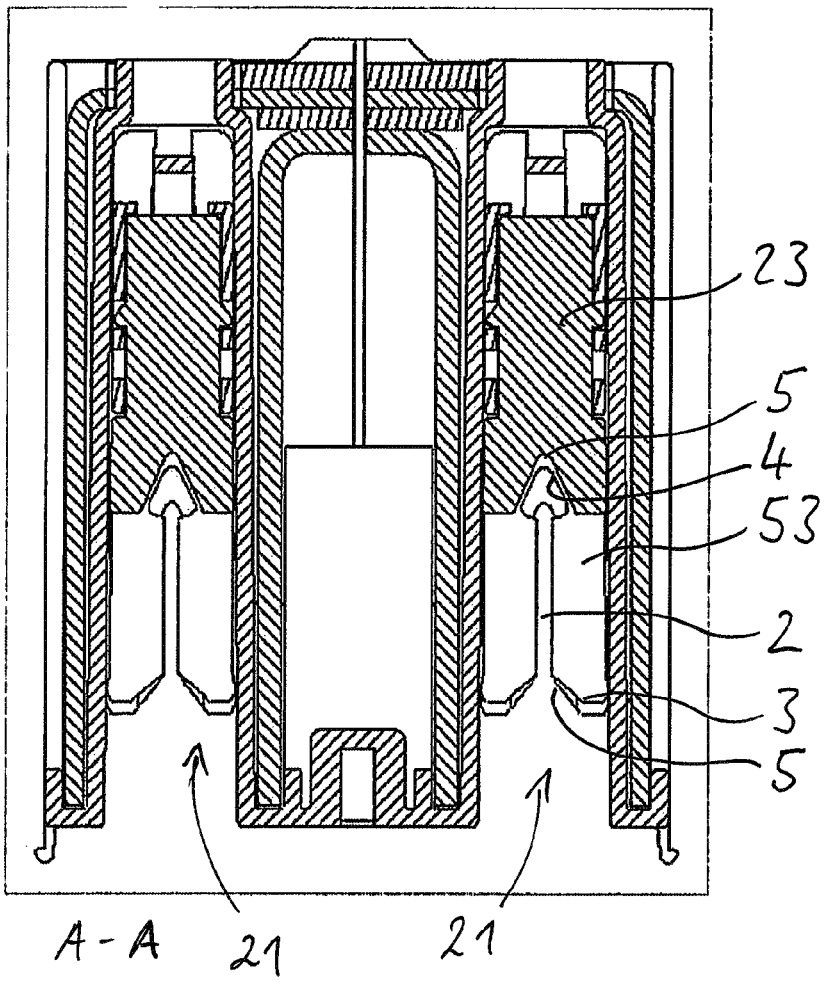
FIG. 3 a further sectional view of the quenching plate arrangement according to FIG. 2 along the line A-A.

FIG. 3 is a further sectional view of the quenching plate arrangement according to FIG. 2 along the line A-A. Therein, two quenching plate arrangements 21 of two adjacent switching chambers (not shown in their entirety here) are shown. The invention provides that each guiding plate 53 has a slit 2, the slit 2 extending from an end 3 of the guiding plate 53 remote from the quenching plates 23. An advantage of the quenching plate arrangement 21 comprising a slitted guiding plate 53 is that the arc gains an additional guide, the slit 2 being provided to guide the arc rapidly into the stack of quenching plates 23. In this case the slit 2 prevents the arc from pausing on the V-shaped groove 5 at the end 3 of the guiding plate 53. By contrast, in the quenching plates 23, which have a comparable V-shaped groove 5, it is desirable for the arc to pause so as to keep the arc in the stack of quenching plates 23 as long as possible.

The slit 2 extends over a sub-length of the guiding plate 53, specifically over the part of the guiding plate 53 that protrudes beyond the quenching plates 23. This provides that the arc pauses at the slit end, causing the arc advantageously to be kept longer in the region of the quenching plates 23. At an end closer to the quenching plates 23, the slit 2 opens into a recess 4, the recess 4 having a greater width than the slit 2. In the embodiment shown, the recess 4 is formed V-shaped. An edge along the slit 2 and along the V-shaped recess 4 may have a bevel (not shown) on both sides at least in portions, causing the arc to pause on the edge for longer. At the end 3 of the guiding plate 53 remote from the quenching plates 23, the slit 2 ends in a V-shaped groove 5, which may likewise be found at the ends of the quenching plates 23 and the intermediate plates. The groove 5 of the intermediate plates, which likewise increases the pause time of the arc, is merely indicated here by way of the recess 4, and for reasons of clarity is not provided with a reference numeral.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

1 Switching chamber
2 Slit
3 End of the guiding plate
4 V-shaped recess
5 V-shaped groove
9 First contact
15 Bridge contact piece
18 Second contact
21 Quenching plate arrangement, quenching device
23 Quenching plates
35 Blow-off channel
37 First running rail arrangement
38 Second running rail arrangement
39 First running rail
40 First running rail
41 Second running rail
42 Second running rail
45 Connecting bracket
53 Guiding plate
54 Intermediate plate

The invention claimed is:

1. A quenching plate arrangement for a switching device, the arrangement comprising:
- a plurality of quenching plates configured to split and/or lengthen an arc; and
- a first guiding plate and a second guiding plate,
- wherein the quenching plates are arranged substantially side by side to form a stack,
- wherein the guiding plates laterally delimit the stack on both sides,
- wherein the guiding plates protrude beyond the quenching plates in a primary extension direction,
- wherein each guiding plate includes a slit that extends from a guiding plate end remote from the quenching plates,
- wherein the slit opens into a recess at an end closer to the quenching plates, and
- wherein the recess has a greater width than the slit.

2. The arrangement of claim 1, wherein the slit extends over a sub-length of the first guiding plate, the sub-length being limited to a part of the first guiding plate protruding beyond the quenching plates.

3. The arrangement of claim 1, wherein the recess tapers in a V shape from the end connected to the slit.

4. The arrangement of claim 1, wherein an edge of the recess includes a bevel on both sides at least in a region tapering in a V shape.

5. The arrangement of claim 1, wherein the slit opens in a V-shaped groove at the end of the first guiding plate remote from the quenching plates.

6. The arrangement of claim 1, wherein the first and second guiding plates are configured substantially identically and arranged mirror-symmetrically with respect to one another.

7. The arrangement of claim 1, wherein, in the plurality of quenching plates, a distance between adjacent quenching plates varies in each case.

8. The arrangement of claim 1, wherein, in the plurality of quenching plates, a distance between adjacent quenching plates varies in each case, such that the distance decreases from a center of the stack towards the guiding plates.

9. The arrangement of claim 1, further comprising:
- an intermediate plate arranged on a face of the first guiding plate remote from the quenching plates arranged to form the stack, and
- wherein the intermediate plate is longer than the quenching plates and shorter than the first guiding plate.

10. A switching device suitable for DC operation, the device comprising:
- a first contact;
- a second contact, at least the second contact being movable with respect to the first contact;
- a first running rail arrangement configured to conduct a first arc having a first current direction;
- a second running rail arrangement configured to conduct a second arc having a second current direction,
- wherein the two running rail arrangements each include a first running rail and a second running rail,
- wherein the two first running rails extend from the first contact in opposite directions,
- wherein the two second running rails extending from the second contact in opposite directions,
- wherein the first running rails are electrically conductively interconnected in the form of a closed loop including the quenching plate arrangement of claim 1 configured to quench an arc occurring between the first contact and the second contact, and
- wherein the quenching plate arrangement is arranged within the closed loop formed by the first running rails.

11. The device of claim 10, wherein the two second running rails are arranged between the two guiding plates when the contacts are open.

12. The device of claim 10, wherein a distance between the first running rails and respective adjacent intermediate plates and a distance between the intermediate plates and respective adjacent guiding plates are less than a distance between the quenching plates.

13. A quenching plate arrangement for a switching device, the arrangement comprising:
- a plurality of quenching plates configured to split and/or lengthen an arc; and
- a first guiding plate and a second guiding plate,
- wherein the quenching plates are arranged substantially side by side to form a stack,
- wherein the guiding plates laterally delimit the stack on both sides,
- wherein the guiding plates protrude beyond the quenching plates in a primary extension direction, wherein each guiding plate includes a slit that extends from a guiding plate end remote from the quenching plates, wherein, in the plurality of quenching plates, a distance between adjacent quenching plates varies in each case, such that the distance decreases from a center of the stack towards the guiding plates.

14. A switching device suitable for DC operation, the device comprising:

a first contact;

a second contact, at least the second contact being movable with respect to the first contact;

a first running rail arrangement configured to conduct a first arc having a first current direction;

a second running rail arrangement configured to conduct a second arc having a second current direction, wherein the two running rail arrangements each include a first running rail and a second running rail, wherein the two first running rails extend from the first contact in opposite directions, wherein the two second running rails extending from the second contact in opposite directions, wherein the first running rails are electrically conductively interconnected in the form of a closed loop including a quenching plate arrangement configured to quench an arc occurring between the first contact and the second contact, the quenching plate arrangement comprising:

a plurality of quenching plates configured to split and/or lengthen the arc; and a first guiding plate and a second guiding plate, wherein the quenching plates are arranged substantially side by side to form a stack, wherein the guiding plates laterally delimit the stack on both sides, wherein the guiding plates protrude beyond the quenching plates in a primary extension direction, and wherein each guiding plate includes a slit that extends from a guiding plate end remote from the quenching plates, wherein the quenching plate arrangement is arranged within the closed loop formed by the first running rails, and wherein a distance between the first running rails and respective adjacent intermediate plates and a distance between the intermediate plates and respective adjacent guiding plates are less than a distance between the quenching plates.

* * * * *